US005320647A

United States Patent [19]

Henning et al.

[11] Patent Number: 5,320,647

[45] Date of Patent: Jun. 14, 1994

[54] FLUENT POLYAZO DYE PREPARATIONS AND METHOD OF DYING LEATHER OR WOOL THEREWITH

[75] Inventors: Georg Henning, Ludwigshafen; Georg Zeidler, Dannstadt-Schwernheim; Ortwin Schaffer, Ludwigshafen, all of Fed. Rep. of Germany

[73] Assignee: BASF Aktiengesellschaft, Ludwigshafen, Fed. Rep. of Germany

[21] Appl. No.: 929,412

[22] Filed: Aug. 14, 1992

[30] Foreign Application Priority Data

Aug. 16, 1991 [DE] Fed. Rep. of Germany ..... 4126995

[51] Int. Cl.[5] ..... C09B 67/42; C09B 67/44; C09B 67/46; C09B 45/32; D06P 3/32

[52] U.S. Cl. ..... 8/437; 8/527; 8/552; 8/550; 8/554; 8/557; 8/673; 8/681; 8/900; 8/902; 8/908; 534/680; 534/684; 534/685; 534/688

[58] Field of Search ..... 8/437, 527, 552, 550, 8/554, 557, 673, 681, 900, 902, 908; 534/680, 684, 685, 688

[56] References Cited

U.S. PATENT DOCUMENTS

| | | | |
|---|---|---|---|
| 3,771,956 | 11/1973 | Aberta | 8/907 X |
| 3,957,432 | 5/1976 | Kuryla | 8/907 X |
| 3,963,432 | 6/1976 | Hauxwell et al. | 8/908 |
| 4,063,880 | 12/1977 | Tullio | 8/41 |
| 4,285,860 | 8/1981 | Hansen et al. | 534/677 |
| 4,405,329 | 9/1983 | Abel et al. | 8/437 X |
| 4,479,906 | 10/1984 | Zeidler | 534/677 |
| 4,491,543 | 1/1985 | Bergmann et al. | 534/677 |
| 4,547,566 | 10/1985 | Bergmann et al. | 534/684 |
| 4,737,240 | 4/1988 | Davis et al. | 162/162 |
| 4,804,387 | 2/1989 | Degen et al. | 8/641 |
| 5,006,128 | 4/1991 | Pedrazzi | 8/437 |
| 5,049,238 | 9/1991 | Kaser | 162/162 |
| 5,127,947 | 7/1992 | Takimoto et al. | 106/22 |
| 5,160,504 | 11/1992 | Ono et al. | 8/437 X |

FOREIGN PATENT DOCUMENTS

| | | | |
|---|---|---|---|
| 0123654 | 10/1984 | European Pat. Off. | 8/907 |
| 0201458 | 11/1986 | European Pat. Off. | 6/641 |
| 0270003 | 6/1988 | European Pat. Off. | 8/641 |
| 0354872 | 2/1990 | European Pat. Off. | 6/22 |
| 0355601 | 2/1990 | European Pat. Off. | 534/684 |
| 0357560 | 3/1990 | European Pat. Off. | 8/437 |
| 0422668 | 4/1991 | European Pat. Off. | 66/22/ |
| 2109493 | 5/1972 | France | 8/908 |

OTHER PUBLICATIONS

Section Ch, Week 8043, Derwent Publications Ltd., London GB; Class A60, AN 80-75852C & JP-A-55 116 759 (Nippon Kagaku Kagyosho) Sep. 9, 1980 Abstract only.

Patent Abstracts of Japan, vol. 7, No. 114 (C-166) (1259), May 18, 1983 & JP-A-58 34 858 (Shiyouwa Kagaku Kogyo K.K.) Mar. 1, 1983 (Abstract only).

Patent Abstracts of Japan, vol. 6, No. 127 (C-113) (1005) Jul. 13, 1982 & JP-A-57 51 759 (Taoka Kagaku Kogyo K.K.) Mar. 26, 1982, Abstract only.

Section Ch, Week 8234, Derwent publications, Ltd., London, GB: Class E21, AN 71237E & JP-A-57 115 468 (Orient Kagaku Kogyo) Jul. 17, 1982 Abstract only.

Patent Abstracts of Japan, vol. 6, No. 191 (C-127) (1069) Sep. 30, 1982 & JP-A-57 102 972 (Orient Kagaku Kogyo K.K.) Jun. 26, 1982 Abstract only.

Patent Abstracts of Japan, vol. 6, No. 143 (C-117) (1021) Aug. 3, 1982 & JP-A-57 65 757 (Nippon Kayaku K.K.) Apr. 21, 1982 Abstract only.

Ullmanns Encyklopadie der Technischen Chemie, 4th Ed., vol. 22, pp. 467-500 (1982).

Katalysatoren, Tenside und Mineraloladditive, 1978, pp. 123-151, H. Grobmann, "Begriffsbestimmung, Systematik, Terminologie" (1978).

*Primary Examiner*—Floyd D. Higel

*Attorney, Agent, or Firm*—Oblon, Spivak, McClelland, Maier & Neustadt

[57] ABSTRACT

Fluent dye preparations useful for dyeing leather or wool contain a) at least 15% of the weight of the dye preparation of one or more polyazo dyes in salt form which have one or more hydroxysulfonyl and/or carboxyl groups and may be present in the form of a 1:1 or 1:2 metal complex, b) from 2 to 15% of the weight of the dye preparation of a surfactant, and c) water.

2 Claims, No Drawings

FLUENT POLYAZO DYE PREPARATIONS AND METHOD OF DYING LEATHER OR WOOL THEREWITH

The present invention relates to novel fluent dye preparations containing a) at least 15% of the weight of the dye preparation of one or more polyazo dyes in salt form which have one or more hydroxysulfonyl and/or carboxyl groups and may be present in the form of a 1:1 or 1:2 metal complex, b) from 2 to 15% of the weight of the dye preparation of a surfactant from the series of the anionic, cationic or nonionic surfactants, and c) water, and to the use thereof for dyeing leather or wool.

The dyeing of leather or wool with polyazo dyes or metal complexes thereof is for occupational hygiene reasons increasingly carried out with the dyes in liquid form. These liquid forms are in general aqueous solutions of the dyes. To obtain such solutions the dyes must be highly soluble. Normally, the solubility of the dye in water should be greater than 100 g/1. This high solubility is usually to be achieved only with a large number of sulfonic acid groups in the dye molecule, which, however, is frequently unfavorable for the application properties of the dye.

It is an object of the present invention to provide novel fluent dye preparations of polyazo dyes which are not suitable for preparing conventional liquid brands.

We have found that this object is achieved by the fluent dye preparations defined in the opening paragraph.

Suitable polyazo dyes for the fluent dye preparations according to the present invention are for example dis-, tris- or tetrakisazo dyes, of which dis- or trisazo dyes are preferred.

Of particular suitability are those polyazo dyes which have one or two hydroxysulfonyl and/or carboxyl groups, preferably one hydroxysulfonyl group, in the molecule.

If the polyazo dyes have suitable substituents, they may also be employed in the form of their 1:1 or 1:2 metal complexes.

Suitable complexing metals for this purpose are in particular copper, cobalt, chromium, nickel and iron, of which iron is preferred.

In the complexes, the metallized groups are preferably each ortho to the azo group, eg. in the form of o,o'-dihydroxy-, o-hydroxy-o -carboxy-, o-carboxy-o-amino- or o'-hydroxy-o'-amino-azo groups.

The polyazo dyes are generally present in the novel fluent dye preparations not in the form of their free acid but in salt form.

Suitable salts for this purpose are metal or ammonium salts. Metal salts are in particular the lithium, sodium or potassium salts. Ammonium salts for the purposes of the present invention are salts which have either substituted or unsubstituted ammonium cations. Substituted ammonium cations are for example monoalkyl-, dialkyl-, trialkyl-, tetraalkyl- or benzyl-trialkyl-anunonium cations or those cations which are derived from nitrogen-containing five- or six-membered saturated heterocycles, such as pyrrolidinium, piperidinium, morpholinium, piperazinium or N-alkylpiperazinium cations or their N-monoalkyl- or N,N-dialkyl-substituted products. Alkyl is here to be understood as meaning in general straight-chain or branched $C_1$–$C_{20}$-alkyl, which may be substituted by hydroxyl and/or interrupted by oxygen atoms in ether function.

The lithium salts are particularly suitable.

Polyazo dyes which in free or complexed form are particularly suitable for the fluent dye preparations according to the present invention are described for example in US-A-4 285 860, US-A-4 479 906, US-A-4 491 543, US-A-4 547 566 or EP-A-355 601.

Dyes which are particularly suitable are for example of the formula

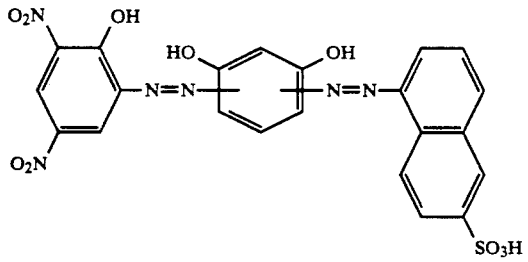

Fe complex

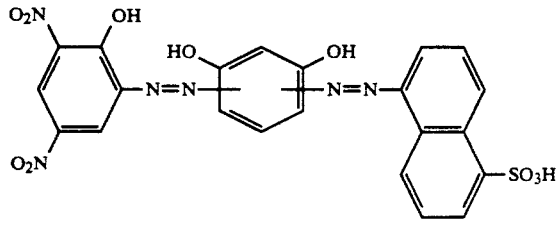

Fe complex

-continued

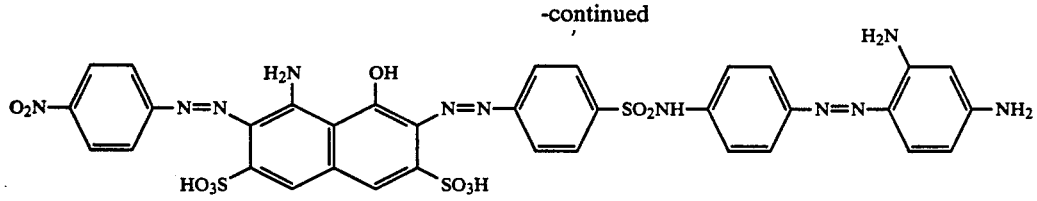

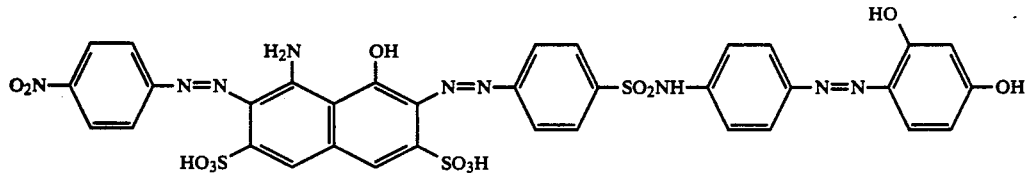

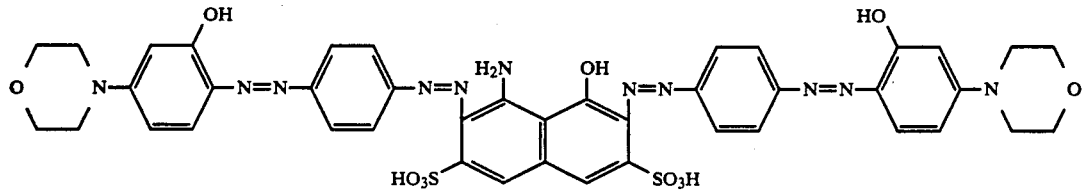

or

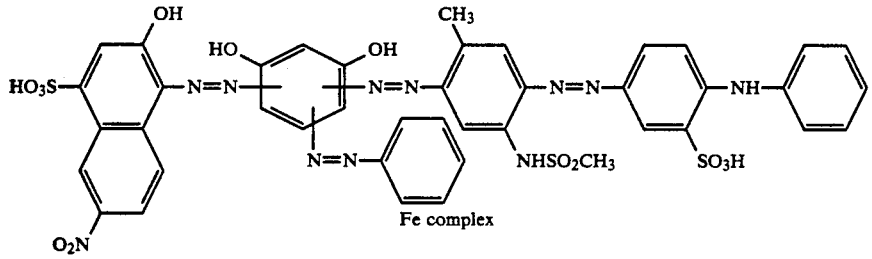

Suitable surfactants for use in the fluent dye preparations according to the present invention are anionic, cationic or nonionic surfactants. Such surfactants are known per se and described for example in Ullmanns Encklopädie der Technischen Chemie, 4th edition, volume 22, pages 467 to 500, or in J. Falbe, U. Hasserodt, Katalysatoren, Tenside and Mineralölhilfsmittel, pages 123 to 151, Georg Thieme Verlag, Stuttgart, 1978.

Suitable anionic surfactants are for example carboxylates, such as carboxymethylaed ethoxylates or derivatives of amino acids, sulfonates, such as ligninsulfonates, alkylbenzenesulfonates, alkylnaphthalenesulfonates, condensation products of naphthalenesulfonic acids with formaldehyde, alkanesulfonates, olefinsulfonates, sulfonated fatty acid esters, sulfonated fatty acid amides, sulfosuccinic esters, alkoxyalkanesulfonates, acyloxyalkanesulfonates or acyla minoalkanesulfonates, sulfates, such as alkyl sulfates or ether sulfates, phosphonates or phosphates.

Suitable cationic surfactants are for example quaternary ammonium compounds, such as tetraalkylannonium compounds or benzyltrialkylammonium compounds, imidazoline derivatives or N-alkylpyridinium salts.

Suitable nonionic surfactants are for example alkoxylates, in particular ethoxylates or propoxylates of alcohols, emnines, fatty acids or fatty acid amides, fatty acid esters of polyhydroxy compounds, eg. of glycerol, sorbitol or sucrose, polyethylene or polypropylene glycols or block copolymers of ethylene oxide and propylene oxide, such as alkyl-ethylene oxide-propylene oxide adducts, polypropylene oxide-polyethylene oxide adducts, trifunctional ethylene oxide-propylene oxide adducts derived for example from glycerol, or tetrafunctional ethylene oxide-propylene oxide adducts derived for example from aliphatic diaxmines, such as ethylenediamine, propylenediamine, butylenediamine, pentamethylenediamine or hexamethylenediamine.

Preference is given to fluent dye preparations which contain a nonionic surfactant.

Particular preference is given to fluent dye preparations containing a nonionic surfactant based on a polyglycol.

Particularly suitable nonionic surfactants based on polyglycols are polyethylene glycols which have an average molecular weight of from 200 to 9000, polypropylene glycols which are derived from 1,2-propanediol and have an average molecular weight of from 600 to 4000, or block copolymers of ethylene oxide and propylene oxide in which the proportion of ethylene oxide is from 10 to 80% of the weight of the block copolymer and the block copolymer has an average molecular weight of from 1000 to 8500.

Of particular importance are nonionic surfactants based on polyethylene glycols, in particular those polyethylene glycols which have an average molecular weight of from 200 to 400.

The fluent dye preparations according to the present invention contain at least 15% of the weight of the dye preparation of one or more polyazo dyes. Preferably, the novel fluent dye preparations contain from 15 to 30% by weight, in particular from 18 to 25% by weight, each percentage being based on the weight of the dye preparation, of one or more polyazo dyes.

The surfactant content of the novel fluent dye preparations is from 2 to 15% by weight, preferably from 2.5 to 10% by weight, in particular from 3.5 to 7% by weight, each percentage being based on the weight of the dye preparation.

The water content of the fluent dye preparation according to the present invention is from 55 to 83% by weight, preferably from 65 to 79.5% by weight, in particular from 68 to 78.5% by weight, each percentage being based on the weight of the dye preparation.

The fluent dye preparations according to the present invention are advantageously prepared by adding the polyazo dye in the forte of the free acid or in salt form to water and the surfactant and stirring the resulting mixture at from 20 to 80° C. for from 1 to 4 hours.

The polyazo dye may be added for example in the forth of an aqueous press cake (dye content about 20–60% of the weight of the press cake), as obtained for example in its synthesis, the dye being normally present therein in the form of its free acid. However, since, as mentioned earlier, it is in general present in the ready-produced dye preparation in salt form, it is advantageous to add an amount of base at the start of the stirring phase which is equivalent to the number of water-solubilizing groups in the polyazo dye. If the polyazo dye is already in salt form, it can be advantageous in some cases to use a polyazo dye salt which has been pretreated by means of ultrafiltration.

The bases are customarily those metal hydroxides or amines on which the abovementioned metal or ammonium salts are based. The bases may be added either without a solvent or else in the form of an aqueous solution.

After the stirring phase has ended, the fluent dye preparation is ready for use.

When the 1:1 or 1:2 metal complexes of azo dyes are employed it can be advantageous in some cases for a postcomplexation to be carried out simultaneously with or after the preparation of the fluent dye preparation according to the present invention. Said postcomplexation is in general effected by adding a dilute aqueous metal salt solution (concentration about 5–20% of the weight of the metal salt solution) and stirring at from 20 to 80° C. for from 1 to 4 hours. Suitable metal salts for this solution are those salts whose cation is identical to the metal cation also present in the 1:1 or 1:2 complex (in particular copper, cobalt, chromium, nickel or iron) and whose anion is for example a halide (in particular chloride) or sulfate.

If in the course of postcomplexation the addition of aqueous metal salt solution raises the water content of the dye preparation to above the abovementioned values, it is advisable to restore the water content according to the present invention by distilling off excess water under reduced pressure.

The novel fluent dye preparations are highly suitable for dyeing wool or in particular leather. They have a long storage life at from −15 to +60° C. They do not separate. Owing to their homogeneity and their fluency, they are simply and accurately dispensable. Moreover, there is none of the dust typical of solid preparations. Furthermore, the process of making the preparations leaves virtually no waste water. Owing to their chemical constitution it was unforeseeable that the above-identified polyazo dyes would be suitable .for forming a fluent dye preparation.

The invention will now be more particularly described by way of example.

EXAMPLE 1

Dye described in US-A-4 547 566, Example 3

1162 g of a moist press cake which contained 26.5% by weight of the dye of the formula

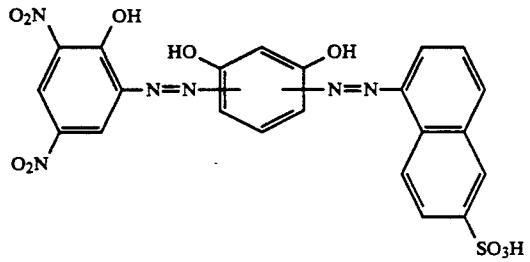

Fe complex in the form of the free acid were added to a mixture of 510 ml of water and 58 g of polyethylene glycol having an average molecular weight of 200. To the resulting mixture were added 27,7 g of lithium hydroxide and then 73 g of 10% by weight iron(II) sulfate solution, This was followed by heating to 50°–60° C. and stirring at that temperature for 2 hours, Then sufficient water was distilled off under reduced pressure until the volume was about 11.5 1 (weight: 1.46 kg; dye content: 21% by weight),

EXAMPLE 2

378 g of the press cake mentioned in Example 1 were added to a mixture of 170 ml of water and 20 g of polyethylene glycol having an average molecular weight of 200. To the suspension were added 9 g of lithium hydroxide and then 24 g of 10% by weight iron(II) sulfate solution. This was followed by heating to 50°–60° C. and stirring at that temperature for 2 hours. Then 145 ml of water were distilled off under reduced pressure. This left 455 g of a 22% by weight dye preparation.

EXAMPLE 3

378 g of the press cake mentioned in Example 1 were added to a mixture of 170 ml of water and 25 g of polyethylene glycol having an average molecular weight of 400. To the suspension were added 9 g of lithium hydroxide and then 24 g of 10% by weight iron(II) sulfate solution. This was followed by heating to 70–80° C. and stirring at that temperature for 1 hour. Then 130 ml of water were distilled off under reduced pressure. This left 475 g of a 21% by weight dye preparation.

EXAMPLE 4

378 g of the press cake mentioned in Example 1 were added to a mixture of 170 ml of water and 20 g of a naphthalenesulfonic acid-formaldehyde condensation product. To the suspension were added 40 g of 50% by weight sodium hydroxide solution and then 24 g of 10% by weight iron(II) sulfate solution. This was followed by heating to 60°–70° C. and stirring at that temperature for 2 hours. Then 77 ml of water were distilled off under reduced pressure. This left 555 g of an 18% by weight dye preparation.

EXAMPLE 5

Dye described in US-A-4 479 906, Example 109

300 g of a moist press cake which contained 33.3% by weight of the dye of the formula

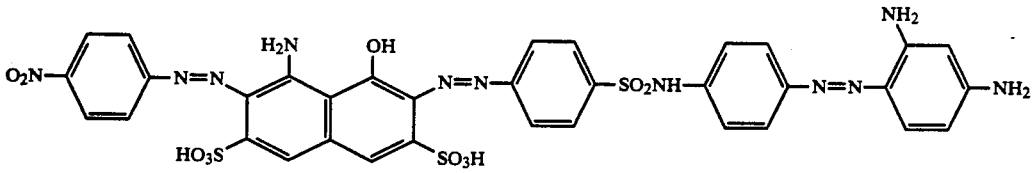

in the form of the free acid were added to a mixture of 60 ml of water and 5 g of a naphthalenesulfonic acid-formaldehyde condensation product. To the suspension were added 18 g of 50% by weight sodium hydroxide solution. This was followed by heating to 50°-60° C. and stirring at that temperature for 1 hour. 383 g of a 26% by weight dye preparation were obtained.

EXAMPLE 6

300 g of the press cake mentioned in Example 5 were added to a mixture of 50 ml of water and 10 g of an alkyl polyglycol ether (having approximately 20 EO units). To the suspension were added 24 g of 50% by weight potassium hydroxide solution. This was followed by heating to 40°-50° C. and stirring at that temperature for 2 hours. 384 g of a 26% by weight dye preparation were obtained.

EXAMPLE 7

300 g of the press cake mentioned in Example 5 were added to a mixture of 80 ml of water and 25 g of polyethylene glycol having an average molecular weight of 300. To the suspension were added 10 g of lithium hydroxide. This was followed by heating to 60°-70° C. and stirring at that temperature for 2 hours. 415 g of a 24% by weight dye preparation were obtained.

EXAMPLE 8

Dye described in US-A-4 479 906, Example 112

176 g of a moist press cake which contained 56.8% by weight of the dye of the formula

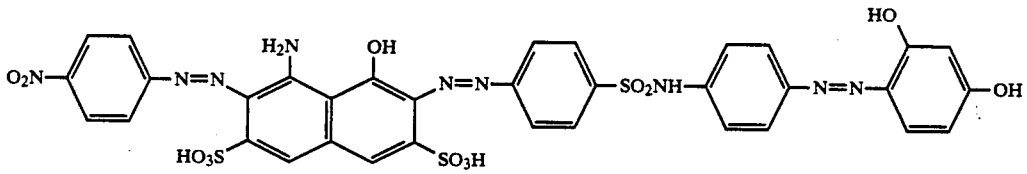

in the form of the free acid were added to a mixture of 140 ml of water and 30 g of polyethylene glycol having an average molecular weight of 300. To the suspension were added 32 g of 50% by weight sodium hydroxide solution. This was followed by heating to 50°-60° C. and stirring at that temperature for 1 hour. 378 g of a 26.5% by weight dye preparation were obtained.

EXAMPLE 9

176 g of the press cake mentioned in Example 8 were added to a mixture of 100 ml of water and 20 g of an alkyl polyglycol ether (having approximately 20 EO units). To the suspension were added 34 g of 50% by weight potassium hydroxide solution. This was followed by heating to 60°-70° C. and stirring at that temperature for 1 hour. 330 g of a 30.3% by weight dye preparation were obtained.

The same method gives preparations of the dyes listed in the following table:

TABLE

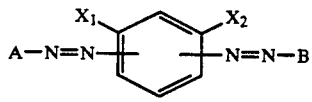

| Example | A | B | $X_1$ | $X_2$ | Hue of dyeing of particular metal complex on leather: Cu | Cr | Co | Ni | Fe |
|---|---|---|---|---|---|---|---|---|---|
| 10 | 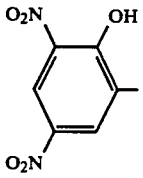 | 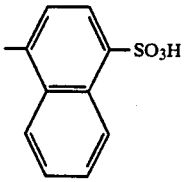 | OH | OH | | | | | yellowish brown |

TABLE-continued
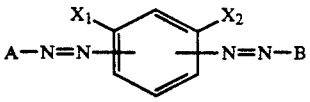
| Example | A | B | $X_1$ | $X_2$ | Hue of dyeing of particular metal complex on leather: Cu | Cr | Co | Ni | Fe |
|---|---|---|---|---|---|---|---|---|---|
| 11 | 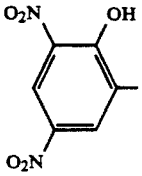 | 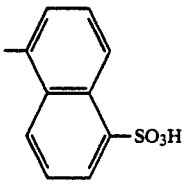 | OH | OH | reddish brown | | | | yellowish brown |
| 12 | 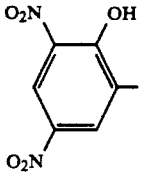 | 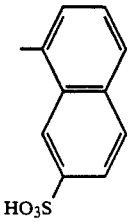 | OH | OH | | reddish brown | | | yellowish brown |
| 13 | 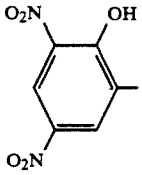 | 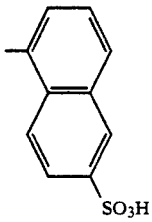 | OH | $NH_2$ | | | | | yellowish brown |
| 14 | 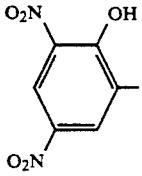 | 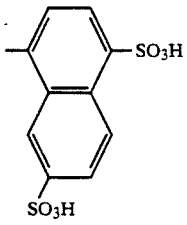 | $NH_2$ | $NH_2$ | | reddish brown | | | |
| 15 | 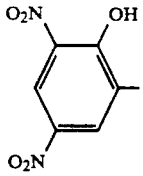 | 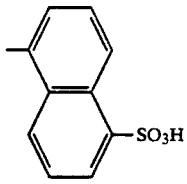 | $NH_2$ | OH | | | | | yellowish brown |
| 16 | 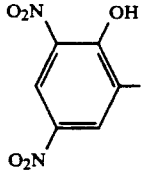 | 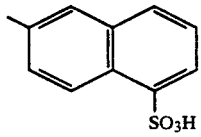 | OH | OH | | | reddish brown | | yellowish brown |
| 17 | 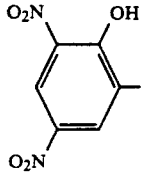 | 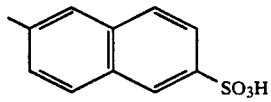 | OH | $NH_2$ | | reddish brown | | | yellowish brown |

TABLE-continued
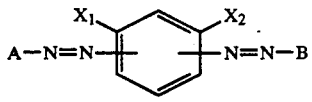
| Example | A | B | $X_1$ | $X_2$ | Hue of dyeing of particular metal complex on leather: Cu | Cr | Co | Ni | Fe |
|---|---|---|---|---|---|---|---|---|---|
| 18 | 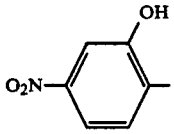 | 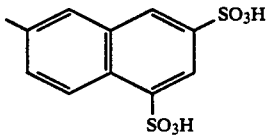 | OH | OH | | | | reddish brown | yellowish brown |
| 19 | 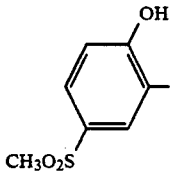 | 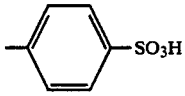 | OH | OH | | | | reddish brown | |
| 20 | 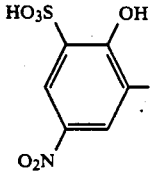 | 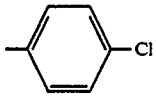 | OH | OH | | reddish brown | | | |
| 21 | 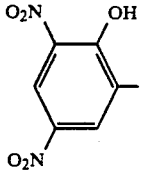 | 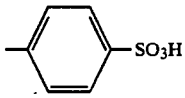 | OH | $NH_2$ | | | | | brown |
| 22 | 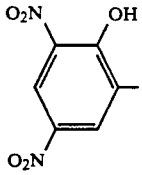 | 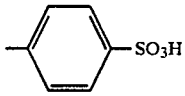 | $NH_2$ | $NH_2$ | | | | | reddish brown |
| 23 | 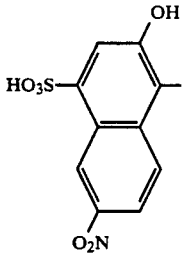 | 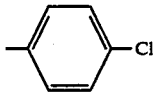 | OH | OH | | | | | brown |
| 24 | 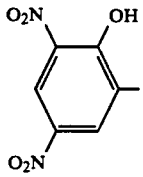 | 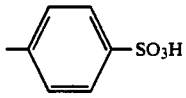 | OH | OH | reddish brown | | reddish brown | | yellowish brown |

TABLE-continued
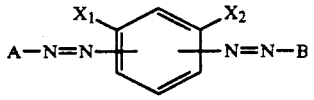
| Example | A | B | $X_1$ | $X_2$ | Hue of dyeing of particular metal complex on leather: Cu | Cr | Co | Ni | Fe |
|---|---|---|---|---|---|---|---|---|---|
| 25 | 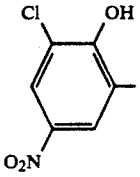 | 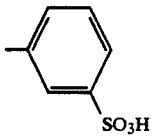 | OH | OH | | | reddish brown | | yellowish brown |
| 26 | 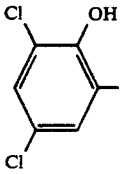 | 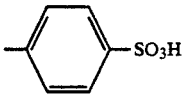 | OH | OH | | reddish brown | | | brown |
| 27 | 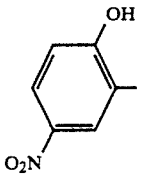 | 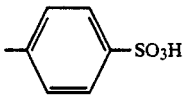 | OH | OH | | | | | brown |
| 28 | 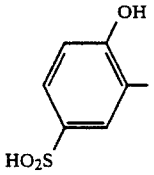 | 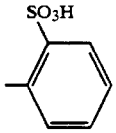 | OH | OH | | reddish brown | | | yellowish brown |
| 29 | 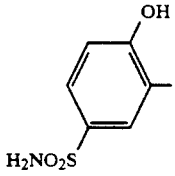 | 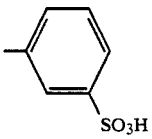 | OH | OH | reddish brown | | | reddish brown | |
| 30 | 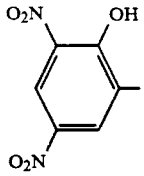 | 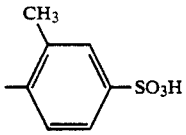 | OH | OH | | reddish brown | | | |
| 31 | 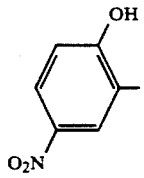 | 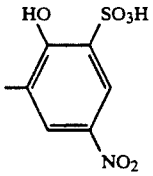 | OH | OH | | | | | brown |
| 32 | 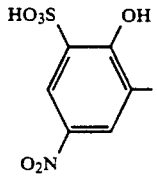 | 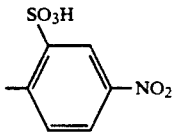 | OH | OH | reddish brown | | reddish brown | | brown |

TABLE-continued
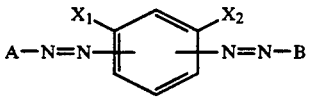
| Example | A | B | $X_1$ | $X_2$ | Hue of dyeing of particular metal complex on leather: Cu | Cr | Co | Ni | Fe |
|---|---|---|---|---|---|---|---|---|---|
| 33 | 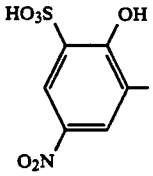 | 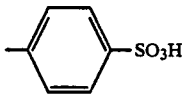 | $NH_2$ | $NH_2$ | | | | | reddish brown |
| 34 | 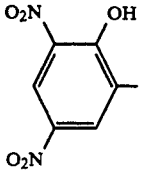 | 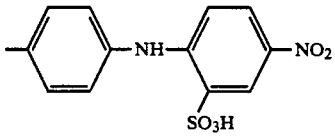 | OH | OH | reddish brown | | | | brown |
| 35 | 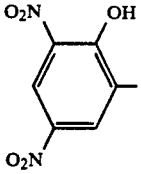 | 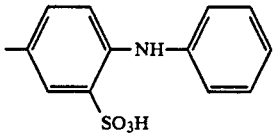 | OH | OH | | | reddish brown | | brown |
| 36 | 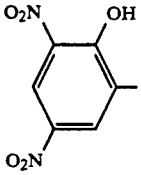 | 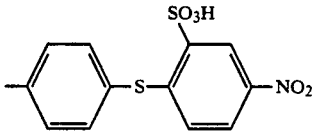 | OH | OH | | reddish brown | | | yellowish brown |
| 37 | 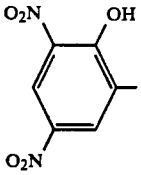 | 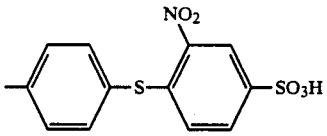 | OH | OH | reddish brown | | | | yellowish brown |
| 38 | 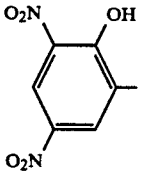 | 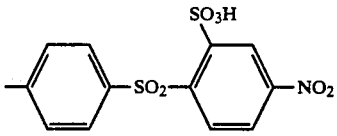 | OH | OH | | reddish brown | | | yellowish brown |
| 39 | 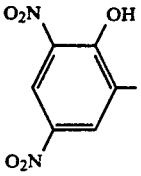 | 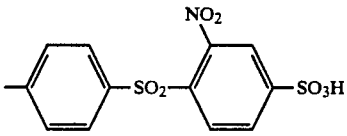 | OH | OH | reddish brown | | | | yellowish brown |

TABLE-continued

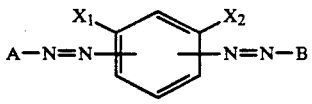

| Example | A | B | $X_1$ | $X_2$ | Hue of dyeing of particular metal complex on leather: Cu | Cr | Co | Ni | Fe |
|---|---|---|---|---|---|---|---|---|---|
| 40 | 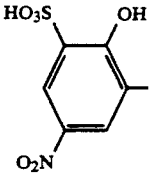 | 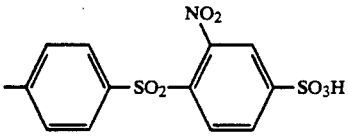 | OH | OH | | | reddish brown | | yellowish brown |
| 41 | 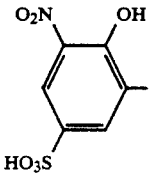 | 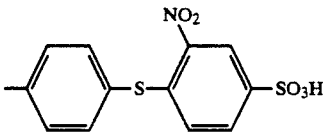 | $NH_2$ | OH | reddish brown | | | | yellowish brown |
| 42 | 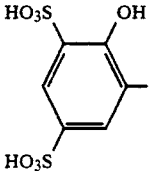 | 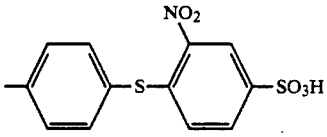 | $NH_2$ | $NH_2$ | | reddish brown | | | |

Example 43

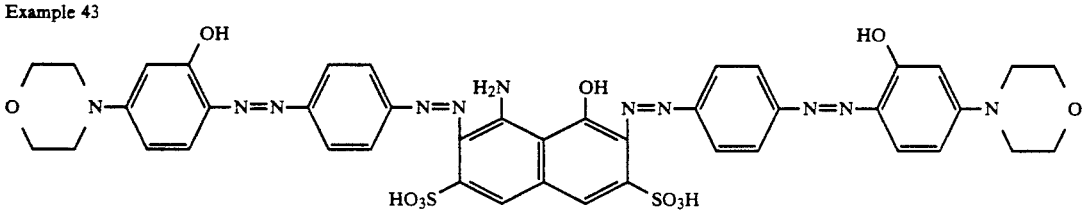

Example 44

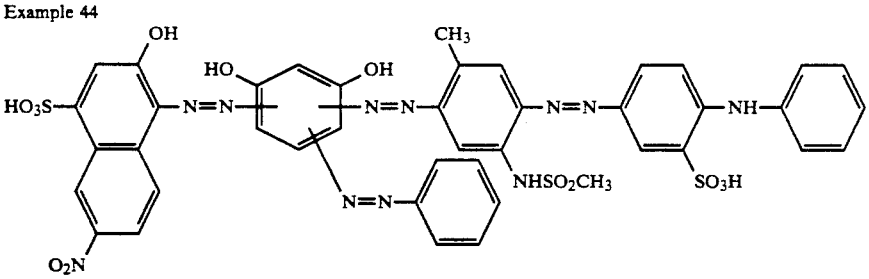

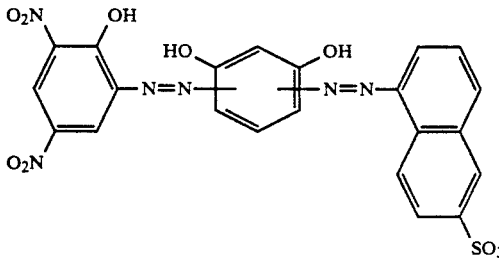

Fe complex and

We claim:

1. A fluent dye preparation comprising:

a) 15 to 30% by weight of the dye preparation of an iron complexed polyazo dye selected from the group consisting of -continued

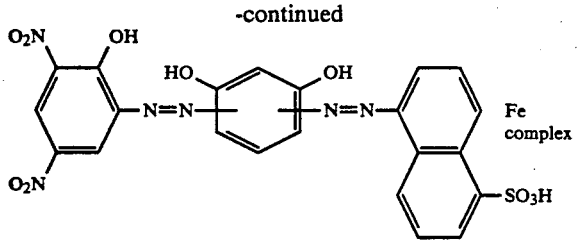

b) from 2 to 15% by weight of the dye preparation of a nonionic surfactant selected from the group consisting of polyethylene glycols which have an average molecular weight of from 200 to 9000, polypropylene glycols which are derived from 1,2-propanediol and have an average molecular weight of from 600 to 4000, and block copolymers of ethylene oxide and propylene oxide in which the proportion of ethylene oxide is from 10 to 80% of the weight of the block copolymer and the block copolymer has an average molecular weight of from 1000 to 8500, and c) water.

2. A method comprising dying leather or wool with a fluent dye preparation as claimed in claim 1.

* * * * *